US007816632B2

(12) United States Patent
Bourke, III et al.

(10) Patent No.: US 7,816,632 B2
(45) Date of Patent: Oct. 19, 2010

(54) INDUCTIVELY HEATED CLOTHING

(75) Inventors: Michael J. Bourke, III, Brighton, MI (US); Brian L. Clothier, Wichita, KS (US)

(73) Assignee: TSI Technologies LLC, Wichita, KS (US)

( * ) Notice: Subject to any disclaimer, the term of this patent is extended or adjusted under 35 U.S.C. 154(b) by 0 days.

(21) Appl. No.: 12/032,357

(22) Filed: Feb. 15, 2008

(65) Prior Publication Data

US 2008/0197126 A1 Aug. 21, 2008

Related U.S. Application Data

(60) Provisional application No. 60/901,703, filed on Feb. 16, 2007.

(51) Int. Cl.
*H05B 6/10* (2006.01)

(52) U.S. Cl. ..... 219/635

(58) Field of Classification Search ..... 219/635–646, 219/600–677

See application file for complete search history.

(56) References Cited

U.S. PATENT DOCUMENTS

| | | | | |
|---|---|---|---|---|
| 4,674,199 | A | 6/1987 | Lakic | |
| 5,140,131 | A | 8/1992 | Macher et al. | |
| 5,374,809 | A * | 12/1994 | Fox et al. | 219/633 |
| 5,620,621 | A | 4/1997 | Sontag | |
| 5,956,866 | A | 9/1999 | Spears | |
| 5,977,517 | A | 11/1999 | Grosjean | |
| 6,148,545 | A | 11/2000 | Yeager, Jr. | |
| 6,232,585 | B1 | 5/2001 | Clothier et al. | |
| 6,320,169 | B1 | 11/2001 | Clothier | |
| 6,504,135 | B2 | 1/2003 | Clothier et al. | |
| 6,620,621 | B1 | 9/2003 | Cohenford et al. | |
| 6,657,170 | B2 | 12/2003 | Clothier | |

(Continued)

FOREIGN PATENT DOCUMENTS

| | | |
|---|---|---|
| KR | 200406402 | 8/2005 |

(Continued)

OTHER PUBLICATIONS

U.S. Appl. No. 60/901,703; entitled Inductively Heated Footwear/Apparel; filed Feb. 16, 2007.

(Continued)

*Primary Examiner*—Daniel Robinson
(74) *Attorney, Agent, or Firm*—Hovey Williams LLP

(57) ABSTRACT

Induction heatable clothing items such as footwear (22) and apparel (160) are provided which include a clothing body having an induction heatable element (36, 108, 112, 114, 116) and preferably having heat retentive material containing phase change material, wherein the element (36, 108, 112, 114, 116) is operable to be heated when subjected to an alternating magnetic field. The clothing items (22, 160) are heated using induction heaters (26, 84). In preferred forms, wireless temperature sensing is used to control heating of the items (22, 160). To this end, the heating elements (36, 108, 112, 114, 116) may be provided with RFID tag/temperature sensor assemblies (58, 60, 110), and the induction heaters (26, 84) are equipped with correlated RFID reader/writer devices (80). Alternately, microwire temperature sensors (120) may be used with the induction heaters (26, 84) having microwire detectors. In other embodiments, temperature monitoring is achieved using impedance detection feedback control.

30 Claims, 5 Drawing Sheets

U.S. PATENT DOCUMENTS

| | | | | |
|---|---|---|---|---|
| 6,701,639 | B2 | 3/2004 | Treptow et al. | |
| 6,855,410 | B2 | 2/2005 | Buckley | |
| 6,953,919 | B2 | 10/2005 | Clothier | |
| 2002/0008632 | A1* | 1/2002 | Clothier | 340/825.37 |
| 2003/0209540 | A1* | 11/2003 | Dahake et al. | 219/635 |
| 2006/0001379 | A1* | 1/2006 | Hecker et al. | 313/623 |
| 2007/0055330 | A1* | 3/2007 | Rutherford | 607/114 |
| 2007/0263699 | A1 | 11/2007 | Clothier et al. | |
| 2007/0267398 | A1 | 11/2007 | McCoy et al. | |
| 2008/0164247 | A1* | 7/2008 | Chen et al. | 219/601 |

FOREIGN PATENT DOCUMENTS

| | | |
|---|---|---|
| WO | 2008101203 | 8/2008 |

OTHER PUBLICATIONS

U.S. Appl. No. 11/496,683; entitled RFID Interrogator/Induction Heating Systems; filed.

U.S. Appl. No. 11/745,348; entitled Magnetic Element Temperature Sensors; filed May 7, 2007.

U.S. Appl. No. 12/018,100; entitled Microwire-Controlled Autoclave and Method; filed Jan. 23, 2008.

U.S. Appl. No. S/N; Resonant Controllable Susceptor; filed.

International Search Report and Written Opinion; PCT S/N PCT/US2008/054145; Filed Feb. 15, 2008.

* cited by examiner

FIG. 1.
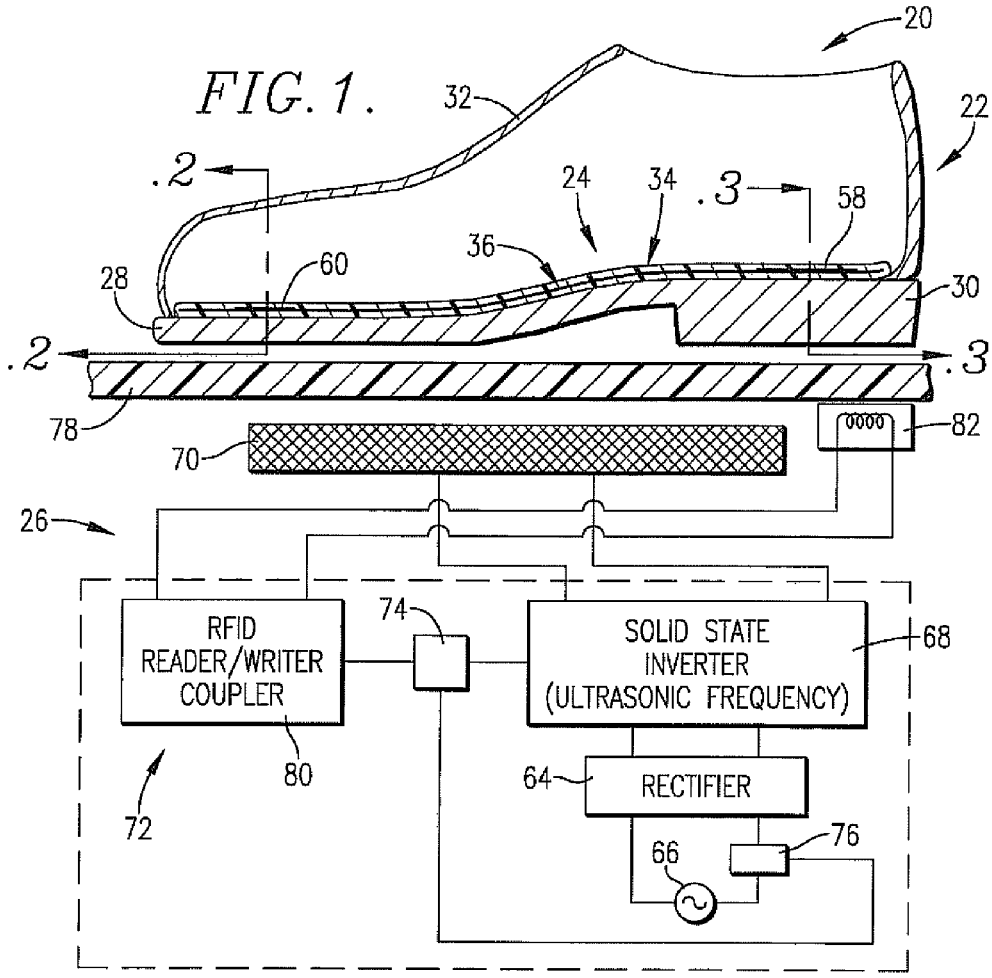
FIG. 2.
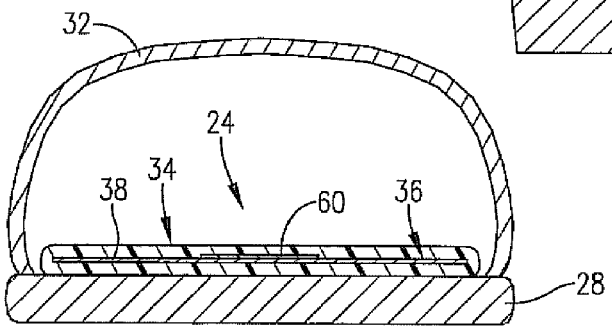
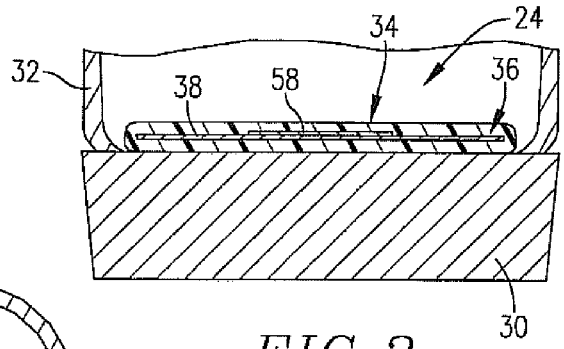
FIG. 3.

INDUCTIVELY HEATED CLOTHING

CROSS REFERENCE TO RELATED APPLICATIONS

This application claims the benefit of Application Ser. No. 60/901,703, filed Feb. 16, 2007, and this application is incorporated by reference herein in its entirety.

BACKGROUND OF THE INVENTION

1. Field of the Invention

The present invention is broadly concerned with clothing items such as footwear and apparel which can be inductively heated for cold weather use. More particularly, the invention is concerned with such clothing items and methods of use thereof wherein the items include an induction heatable element which is heated when subjected to an alternating magnetic field. The invention also pertains to assemblies including such heatable clothing along with an induction heater designed to heat the elements of the clothing. In preferred forms, the clothing items include a device serving to limit the maximum temperature of the heatable elements, and closed loop, wireless temperature feedback allowing temperature control and maintenance.

2. Description of the Prior Art

Heated clothing such as footwear or apparel has a number of advantages, particularly for those who work outside in cold climates or for those engaged in cold-weather sports such as skiing. Such heated clothing can improve physical performance, minimize cold-related discomfort, and can provide a degree of safety during prolonged winter time exposure.

Many methods for heating clothing have been proposed in the past. The two most common techniques utilized either battery power or chemical energy. Battery powered heatable clothing items include relatively heavy batteries and associated resistance heating circuitry. Such systems can be a problem because the circuit wiring may be broken during extended use and can be difficult to launder. Moreover, the batteries tend to be bulky and are often placed in awkward positions, such as on the wrist for heated gloves. Chemical energy systems use chemical packs that heat when exposed to oxygen. The user places these packs inside pockets of apparel or, in the case of footwear, as inserts placed adjacent the soles of the footwear. These heating packs do not perform well where airflow is restricted, such as in footwear applications. Further, these packs are designed for single use only, which significantly increases costs and creates waste disposal problems.

U.S. Pat. Nos. 5,956,866 and 5,140,131 describe battery/resistance heating systems in footwear and other clothing items. Similarly, U.S. Pat. Nos. 6,620,621 and 5,977,517 describe battery powered heatable apparel. The '621 patent specifically discloses battery-warmed gloves requiring a battery on each glove. The '517 patent employs heatable panels placed inside a vest, and powered by a battery. U.S. Pat. No. 6,148,545 uses an external heater applied to footwear. This patent also suggests use of phase change material to store heat produced by the external device. This system does not permit reheating while the footwear is worn, and requires long warming times owing to restricted heat transfer over small surface areas. All of these systems suffer from the problems of excess weight, lack of durability and cleanability issues.

U.S. Pat. No. 6,701,639 describes a removable shoe insole heated by an exothermic chemical reaction. In this system, the user must remove the footwear and the associated insole in order to insert the heating source. Again, this type of heating is deficient in that the heating elements are of single use design and must be periodically replaced by the user.

There is accordingly a need in the art for improved heatable clothing which does not add significant weight or complexity to the clothing, which can be readily reheated without removal of the clothing, and which provides closed loop temperature feedback control during heating.

SUMMARY OF THE INVENTION

The present invention overcomes the problems outlined above and provides improved induction-heatable clothing items (e.g., footwear and apparel), as well as clothing assemblies including such clothing items and associated induction heaters. Broadly speaking, the clothing items of the invention include a clothing body with an induction heatable element operably associated with the body. The element is operable to be heated when subjected to an alternating magnetic field so as to provide warmth to a wearer of the clothing item. In order to prevent undue heating which may be dangerous, the clothing item is preferably provided with a device operably coupled with the heating element in order to limit the maximum temperature thereof during the course of heating. The clothing assemblies further have an induction heater configured for placement in proximity to the heating element and operable to generate an alternating magnetic field for induction heating purposes. In use, a clothing item is placed on or near the induction heater and the latter is operated to heat the element, and thus the clothing item, to a desired extent.

The heatable elements of the clothing items can take a number of forms. For example, susceptor coils can be placed on or embedded within a particular item of clothing. Alternately, thin sheets of metallic material could be used in this context. Another possibility is the use of a susceptible material such as graphite embedded within a synthetic resin matrix. If desired, the clothing item may also include heat-retentive phase change material to serve as a heat sink.

Normally, the clothing items include a temperature sensor associated with the heating element, as well as a thermal switch or fuse which limits the maximum temperature of the element during heating. In particularly preferred forms, wireless closed-loop temperature feedback control is also provided. For example, the clothing item may include an RFID tag operably coupled with the temperature sensor. In such an embodiment the induction heater is equipped with an RFID antenna and controller allowing the heater to interrogate the RFID tag and receive temperature information derived from the sensor. Such information is then used to at least in part control the operation of the induction heater. In this fashion, the heatable element can be continuously heated within a range of desired temperatures. RFID temperature feedback control is described in U.S. Pat. Nos. 6,320,169 and 6,953,919, incorporated by reference herein. In other embodiments, microwire temperature sensors are used with the clothing items and the induction heater includes a microwire reader, as disclosed in U.S. Patent Publication 2007/0263699, incorporated by reference herein. Similarly, the temperature control method disclosed in U.S. patent application Ser. No. 11/496,683 (incorporated by reference herein) may be used. An impedance detection temperature feedback system may also be employed, as described in U.S. Pat. No. 6,232,585, incorporated by reference herein.

In another embodiment, a battery powered, resistance-heated clothing item may be improved by providing an inductively powered battery charging assembly with the clothing item. Such a charging assembly includes an induction coil operably coupled with the battery and operable to generate a charging current when subjected to an alternating magnetic field.

The present invention can be used with virtually all types of clothing items worn by humans or animals. For example, clothing items selected from the group consisting of footwear, stockings, gloves, hats, trousers, shirts, jackets, and coats can all be improved using the principles of the invention.

BRIEF DESCRIPTION OF THE DRAWINGS

FIG. 1 is a schematic view in partial section and depicting an inductively heatable shoe in accordance with the invention where the heating assembly is removable from the shoe, operably situated on an induction heater for the shoe;

FIG. 2 is a fragmentary vertical sectional view taken along the line of 2-2 of FIG. 1 and illustrating a temperature sensor in the toe region of the shoe;

FIG. 3 is a fragmentary vertical sectional view taken along the line of 3-3 of FIG. 1 and depicting an RFID tag adjacent the heel region of the shoe;

DETAILED DESCRIPTION OF THE PREFERRED EMBODIMENT

Turning now to the drawings, an induction footwear assembly 20 is illustrated in FIGS. 1, 1A, 2, and 3 and broadly includes a shoe 22 equipped with an induction heatable insole insert 24, as well as an induction heater 26. As shown, the shoe 22 is positioned atop heater 26 in an orientation for induction heating of the insert 24 as will be described.

Figure 1A:
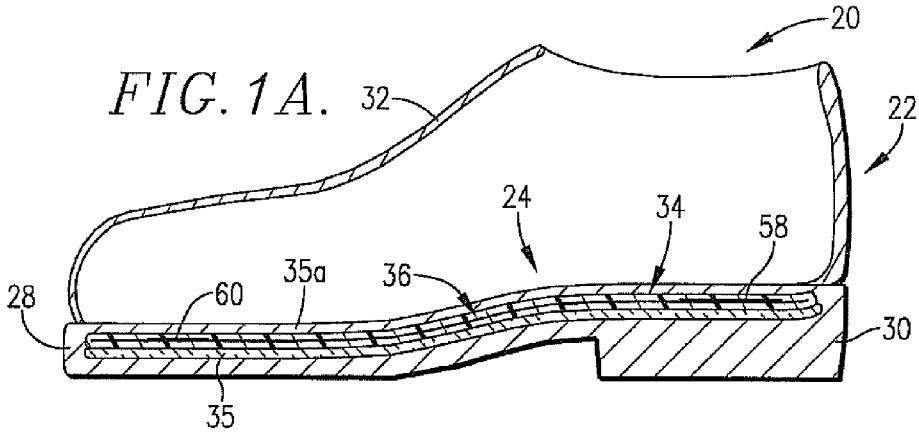
FIG. 1A is a schematic view in partial section and depicting an inductively heatable shoe in accordance with this invention where the heating and insulating assembly are a permanent part of the shoe.

The shoe 22 in FIG. 1 is itself entirely conventional and includes a sole 28, heel 30, and upper 32. An insert 24 is placed within the shoe and can be removed. The shoe 22 in FIG. 1A uses conventional construction but has the insert 24 molded into the sole 28 and/or heel 30. A layer of thermal insulation 35 such as aerogel manufactured by companies such as Aspen Aerogel is provided below the insert 24. The insert 24 is fully encapsulated in the sole 28 and/or heel 30 by a layer 35*a*. Alternatively, the top of insert 24 may be covered by a separate cover layer 35*a* which is formed of polymer-based materials, leather, or other materials commonly used in footwear. In either case, the insert 24 is in the form of a molded body 34 formed of suitable synthetic resin material (e.g., urethane, thermoplastic polyurethane, silicone, or other elastomeric polymers) and having a central heatable element 36 therein. The insert may alternatively be formed of heat resistant fabric material such as those marketed by Outlast Technologies Inc. of Boulder, Colo., wherein the fabric is formed in layers surrounding a central heatable element 36.

Figure 5:
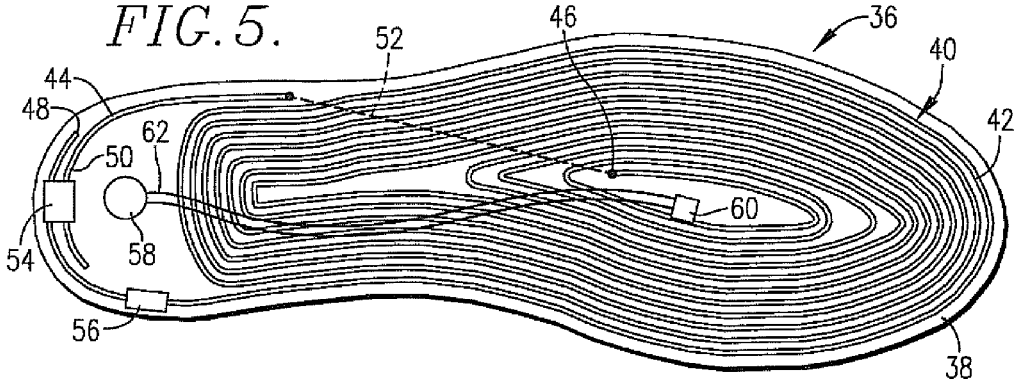
FIG. 5 is a plan view of a shoe heating assembly including a susceptor coil with an RFID tag in the heel region of the assembly and a temperature sensor in the forward region of the assembly.

The body 34 may also include heat retentive phase change material blended into the polymer matrix, such as microencapsulated paraffin. The element 36 may be in sheet form of graphite or an appropriate ferromagnetic metal or as graphite blended into the body 34. Preferably, however, the element 36 is of the type illustrated in FIG. 5. Broadly, this element 36 includes a thin, planar base sheet 38 formed of heat resistant synthetic resin (e.g. Kapton). The sheet 38 supports a susceptor coil 40 on one face thereof in the form of primary and secondary tracings 42 and 44 formed of copper or other suitable metallic materials. The tracing 42 presents a series of spaced convolutions and has an inner end 46 and outer end 48. The secondary tracing 44 includes a segment 50 adjacent outer end 48 and includes a connector portion 52 on the opposite face of sheet 38 which connects with inner end 46. A tuning capacitor 54 is electrically connected to end 48 and segment 50 in order to complete the circuit for coil 40. Also, a conventional thermal switch 56 is provided in primary tracing 42. This switch (preferably a Pepi model N creep action bimetallic thermal protector commercialized by Portage Electric Products, Inc.) is designed to open the coil circuit at a predetermined maximum temperature in order to prevent undue heating of the element 36.

The element 36 further includes an RFID tag 58 in the heel area of the sheet 38, and a temperature sensor 60 positioned in the forward central area of the sheet 38. Appropriate connection wires or etched copper traces 62 serve to interconnect sensor 60 and RFID tag 58. Additionally, either the separate, complete RFID tag assembly and/or temperature sensor or the components comprising the same (e.g. integrated circuit, antenna traces, temperature sensor) may be directly attached to the sheet 38.

The induction heater 26 comprises a rectifier 64 coupled with an alternating current source 66 in order to convert the alternating current to direct current. The rectifier 64 is coupled to a solid state inverter 68 in order to convert the direct current into ultrasonic frequency current (preferably from about 20-100 kHz). The inverter 68 is coupled to an induction work coil 70 for powering the latter. A microprocessor-based control circuit 72 also forms a part of the heater 26 and has a microprocessor 74 operably coupled with a controlling the inverter 68. The circuitry 72 may also control other of the heater's internal and user-interface functions. The control circuitry 72 also includes a circuit parameter sensor 76 coupled with microprocessor 74 to measure a parameter related to or depending upon the load experienced by the heater 26 during use; in practice, this may be a current sensor within inverter 68 which measures current through one of the inverter's switching transistors or may be a current sensor located at some point prior to the rectifier 64 that measures current through the current-carrying line connecting the commercial power source 66 to the rectifier 64. The heater 26 is equipped with a support plate 78 that is located above work coil 70 and is designed to support shoe 22 as illustrated.

The heater 26 is also equipped with an RFID reader/writer 80 connected with microprocessor 74; this connection preferably allows RS-232 protocol communications. The preferred reader/writer 80 is Tagsys' Medio P031. This unit has a serial TTL communication protocol and can transmit data at up to 9600 baud. A RFID antenna 82 is operatively coupled with reader/writer 80 via appropriate cabling, and is located beneath the RFID tag 58 of insert 24. The preferred antenna 82 is commercialized by Tagsys, Inc. The heater 26 may also include a real-time clock and backup power supply (not shown). The microprocessor 74 may also include reprogrammable memory allowing a user to modify the software control algorithms for the heater 26.

In use, the user places shoe 22 on heater 26 as illustrated FIG. 1, with work coil 70 directly beneath element 36 and with RFID tag 58 within the field of antenna 82. The operation of heater 26 is then initiated, so that the coil 70 generates an alternating magnetic field of appropriate frequency for heating element 36, and particularly the coil 40 thereof. Specifically, the alternating magnetic field will induce a current in the resonant circuit defined by the coil 40. This current will flow completely through the circuit, even in those areas not in proximity to the field. The induced current creates heat through joule heating of the coil 40. This in turn heats the insert 24 and the heat retentive material therein. During this heating, a closed-loop wireless temperature feedback is established between temperature sensor 60, RFID tag 58, antenna 82, reader/writer 80, and control microprocessor 74. At the outset of heating, operating data is retrieved from the RFID tag 58, and may include information as to the type of object being heated, maximum operating heating temperatures, and maximum power. This information uses this data to initiate operation of the work coil 70. Throughout the course of heating, the RFID tag 58 is periodically interrogated to obtain temperature information derived from the sensor 60. This information is used by microprocessor 74 in order to control the operation of heater 26 so as to establish and maintain a proper temperature in susceptor coil 40. This type of heating and control is described in U.S. Pat. No. 6,953,919, incorporated by reference herein.

Of course once insert 24 is heated to the desired temperature, the shoe 22 will provide prolonged warmth to the wearer. This long lasting warmth is present after removal from the induction heater due to the heat retentive phase change material within the body 34.

Figure 12:
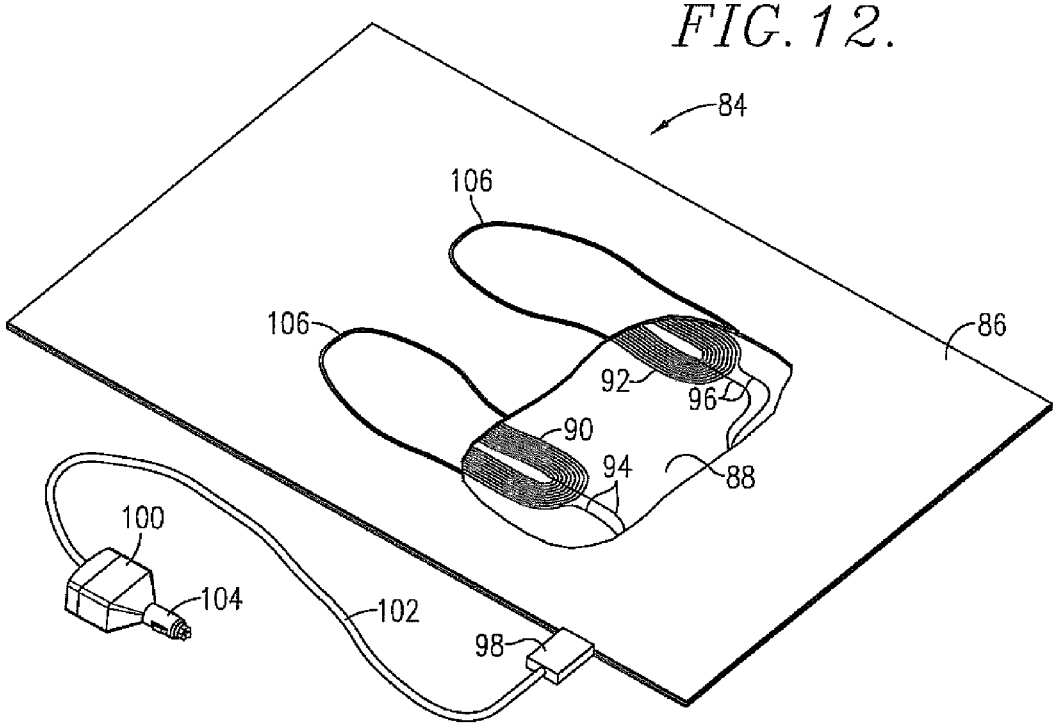
FIG. 12 is a perspective view with parts broken away of a mat induction heating unit designed to inductively heat footwear in accordance with the invention.

The embodiment of FIG. 1 may be altered in many ways without departing from the principles of the present invention. First of all, although the insert 24 is illustrated as being separate from the shoe 22, an induction heatable element may be incorporated into the shoe 22 during manufacture thereof. Moreover, the induction heater 26 may take several forms. It may be in the shape of a standard induction cooktop (e.g., a CookTek C-1800) or a standard bathroom scale. Alternately, a substantially flat, portable charging mat 84 (see FIG. 12) adapted to lie on a floor or other support surface may be employed. The mat 84 includes upper and lower interconnected elastomeric sheets or plys 86, 88. A pair of shoe sole-shaped induction work coils 90, 92 are sandwiched between the sheets 86, 88 and have connector leads 94, 96 operably coupled with connector box 98. Preferably, RFID antennas (not shown) are located adjacent the coils 90, 92, depending upon the location of the corresponding RFID tags 58 of the heating elements 36. A terminal box 100 (preferably in the shape and configuration of prior art car inverters such as the Wagon Tech Smart AC Watt Inverter) is connected with connector box 98 via coaxial cable 102. The terminal box 100 houses induction charging circuitry of the type described in connection with heater 26 and is operable to powering work coils 90, 92. Box 100 also has an elongated electrical plug 104 designed to fit within a DC automobile power outlet. The upper sheet 86 has a pair of shoe sole outlines 106 respectively surrounding the work coils 90, 92 therebeneath. In the use of charging mat 84 the plug 104 of terminal box 100 is plugged into an automotive DC power outlet, and the user locates shoes 22 within the outlines 106 on sheet 86. The shoes 22 may be worn if desired during the heating operation, or they may simply be placed on the mat 84. At this point the heating operation is initiated and completed in the same manner as the FIG. 1 embodiment.

Other modifications can be made to the induction heater 26 or mat 84. For example, mechanical stops may be affixed to the heater or mat so as to align the shoes 22 in optimal positions for maximum energy transfer between the work coils 70 and 90, 92 and the associated susceptor coils of the inserts 24. In addition, the heater 26 or mat 84 may be designed so that no heating will occur unless the shoes 22 are in an optimal heating location. Thus, energy transfer would not be allowed to occur unless and until there was a successful reading of the RFID tags of the heating elements 36, where the alignment of an RFID tag directly over an RFID antenna (and thus alignment of the susceptor coil with the work coil of the induction heater) is required for a successful reading. Power monitoring may also be employed to determine that the shoes 22 were properly positioned over the associated work coils. The determination of low energy transfer could be employed to give the user a visual or aural prompt to move the shoes 22 to a more optimal charging position.

Figure 4:
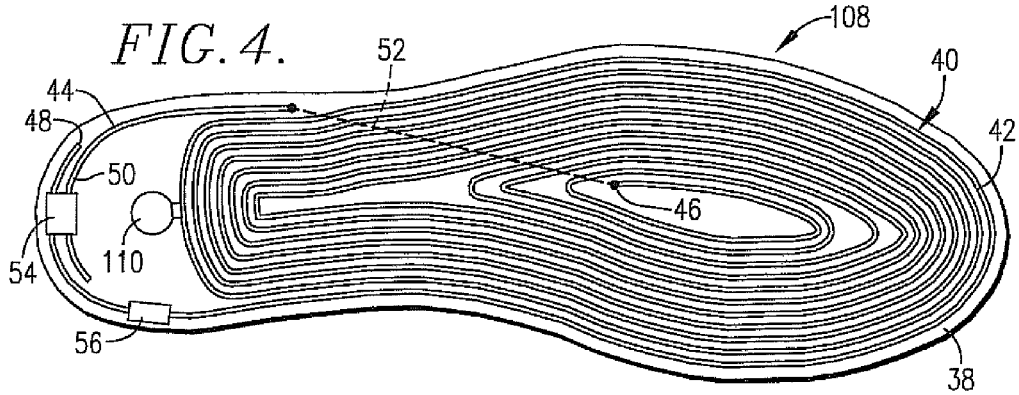
FIG. 4 is a plan view of a shoe heating assembly including a susceptor coil with an RFID tag and temperature sensor in the heel region of the assembly.
Figure 6:
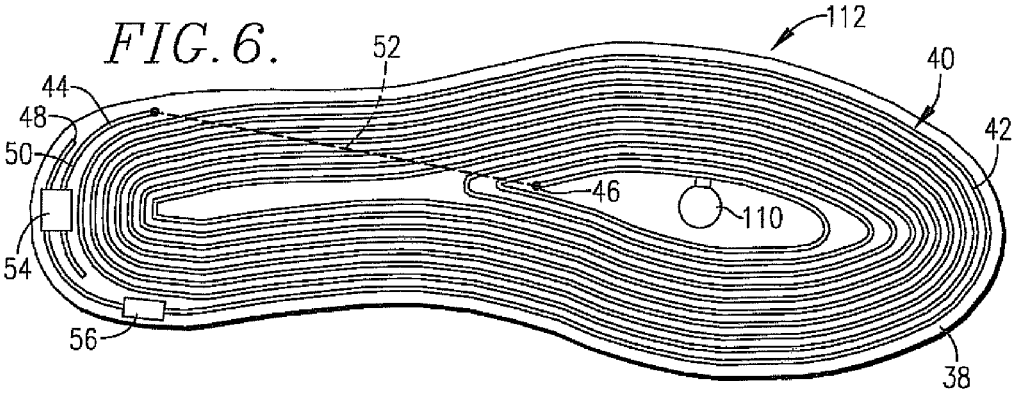
FIG. 6 is a plan view of a shoe heating assembly including a susceptor coil with an RFID tag and temperature sensor in the forward region of the assembly.
Figure 7:
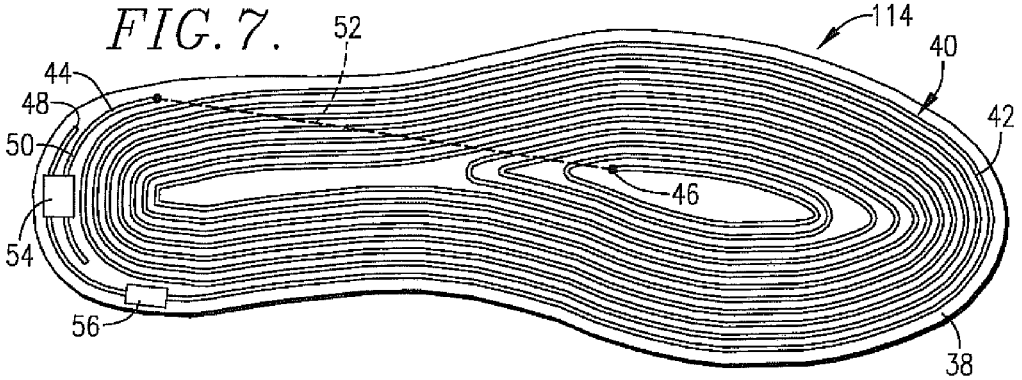
FIG. 7 is a plan view of a shoe heating assembly including a susceptor coil and designed to provide impedance detection temperature feedback.

The susceptor coil heating elements 36 can also be modified in a number of ways. Exemplary embodiments are illustrated in FIGS. 4 and 6-7, which are similar to the FIG. 5 design. Accordingly, components described with reference to FIG. 5 which also appear in FIGS. 4 and 6-7 bear the same reference numerals. Referring to FIG. 4, an element 108 is provided which is very similar to that of FIG. 5, but which has a combined RFID tag and temperature sensor 110 located in the heel region. Preferably, the tag and sensor are directly connected together, thus eliminating the need for the connection wires or connection traces 62 of FIG. 5. FIG. 6 depicts another heating element 112 which has the combined RFID tag/temperature sensor 110 located in the forward region of the sensor element.

Finally, FIG. 7 illustrates a heating element 114 which does not have an RFID tag or temperature sensor. This embodiment makes use of an impedance detection temperature feedback control system described in U.S. Pat. No. 6,232,585. Specifically, this temperature regulation technique involves regulation about an impedance threshold of the "no-load" detector forming a part of the heating device 26 or charging mat 84. In this method, the no-load circuitry, whose purpose is to prohibit continuous magnetic field production when the impedance of the load is improper, is used to temperature regulate an induction heatable heating element.

In many magnetic induction heating devices, the impedance that the external load presents to the resonant circuit is indirectly detected by measuring the amplitude of the resonance current flowing through the work coil or through the AC line coming in from the commercial power supply to the inverter. A variety of resonant circuit parameters may be used for such detection. Regardless of the exact circuit parameter measured, every no-load detection system ultimately reacts to a threshold value of load impedance, below which the continuous magnetic field production is interrupted. In this technique, a heating element is magnetically coupled to the work coil and provides an impedance to the heater's resonant circuit that changes in a predictable, controlled fashion such that the amplitude of the resonant current (or current flowing to the rectifier) consistently moves through the threshold resonant current value (or current value of the load at the same temperature). When this occurs, the heater's no-load detector de-energizes the work coil, thereby eliminating field production and thus interrupting the joule heat of the heating element at the temperature corresponding to the threshold value of resonant current amplitude (or threshold value of current flowing to the rectifier).

Figure 11:
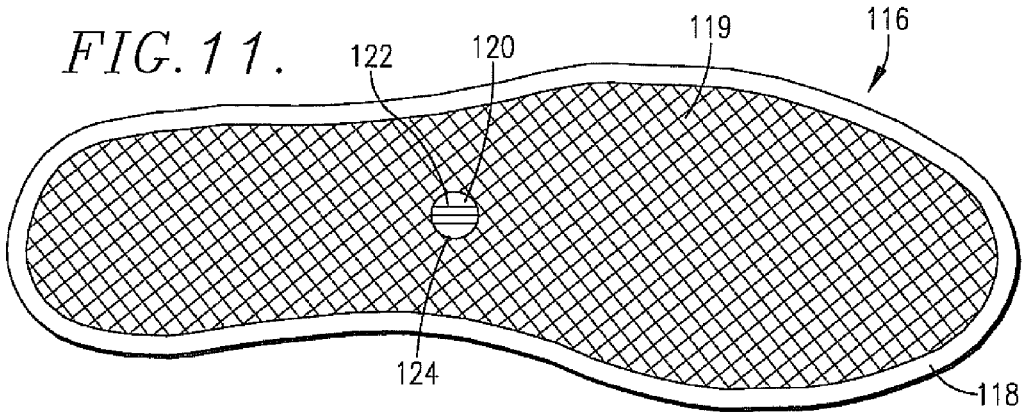
FIG. 11 is a plan view of a shoe heating assembly including a graphite matrix.

A still further type of heating element 116 is illustrated in FIG. 11. In this design, a synthetic resin body 118 in a shape of a shoe sole is provided. The body 118 is formed of an appropriate synthetic resin material and has within the resin matrix graphite particles 119. In alternate forms, resin matrix ferromagnetic particles or sheet graphite material which can be inductively heated may be used in lieu of the particles 119. For example, multiple-ply designs having inductively heatable layers with heat retentive phase change material therebetween can be used in this context as fully described in U.S. Pat. No. 6,657,170, incorporated by reference herein. This embodiment also makes use of a microwire temperature sensor 120 of the type described in U.S. Patent Publication No. 2007/0263699, as well as pending U.S. patent application Ser. No. 11/745,348 filed May 7, 2007 and Ser. No. 12/018,100 filed Jan. 23, 2008, all of the foregoing being incorporated by reference herein.

Specifically, the sensor 120 comprises at least one, and in this embodiment three, magnetically susceptible microwires 122 supported on a heat-resistive synthetic resin substrate 124. The microwires 122 have a characteristic re-magnetization response under the influence of an applied alternating magnetic field in the form of at least one short, detectible pulse of magnetic field perturbation of defined short duration and which is different below and above at least one set point temperature, and is preferentially detectibly different over a small range of temperatures below the set point temperature. The set point temperature of each microwire 122 is preferably the Curie temperature thereof, or a temperature close (usually within about 25° C.) of the Curie temperature. When an alternating magnetic field is applied to the sensor 120 of sufficient magnitude to cause the desired re-magnetization response, the sensor 120 operates in the manner of a "temperature switch." That is, when the heating element 116 is below the set point temperature of the sensor 120, a re-magnetization response from the sensor 120 is observed; when the element 116 reaches or exceeds maximum set point temperature of the sensor 120 either no re-magnetization is observed, or the observed response is altered. This information is then used to control the induction heating of element 116.

Normally, and as shown in FIG. 11, sensor element 120 makes use of a plurality of microwires 122 each having a different set point temperature. Preferably, the plural microwires are designed to have successive different set point temperatures which vary from lowest to highest and in at least a somewhat uniform fashion, so that the temperature of the element 116 can be monitored over a range of desired temperatures.

In order to most effectively make use of the microwire temperature sensor 120, use is made of a detector correlated with the sensor elements. Such a detector generally has a device for generating an alternating magnetic field of sufficient magnitude to interrogate the sensor elements (i.e., to cause re-magnetization responses of the sensor elements based upon the temperature of the object), and a device for detecting such responses. In practice, the detector has a magnetic field generator coil and a field receiving coil both coupled with a signal processing unit. In use, the detector generates the requisite alternating magnetic field, and the field receiving coil detects the re-magnetization responses of the sensor elements, issuing output signals to the signal processing unit. The signal processing unit, preferably in the form of a microprocessor, employs a decoding algorithm which allows determination of the object temperature. In preferred forms, the decoding algorithm comprises one or more look-up tables correlating the re-magnetization responses of the sensor elements with object temperature. In the context of heater 26, the described microwire detector should be employed in lieu of the RFID reader/writer 80.

The magnetically susceptible microwires 122 are advantageously formed as metallic bodies in an amorphous or nanocrystalline state. Such metallic bodies are preferably in the form of very thin elongated wires or strips having a maximum cross-sectional dimension (e.g., diameter) of up to about 100 nm and can be produced in a variety of manners. One particularly suitable form of the metallic bodies is the microwire form, comprising an inner metallic core and an optional outer glass coating. Such microwires can be produced by the well-known Taylor method or as water-cast amorphous bodies.

Figure 10:
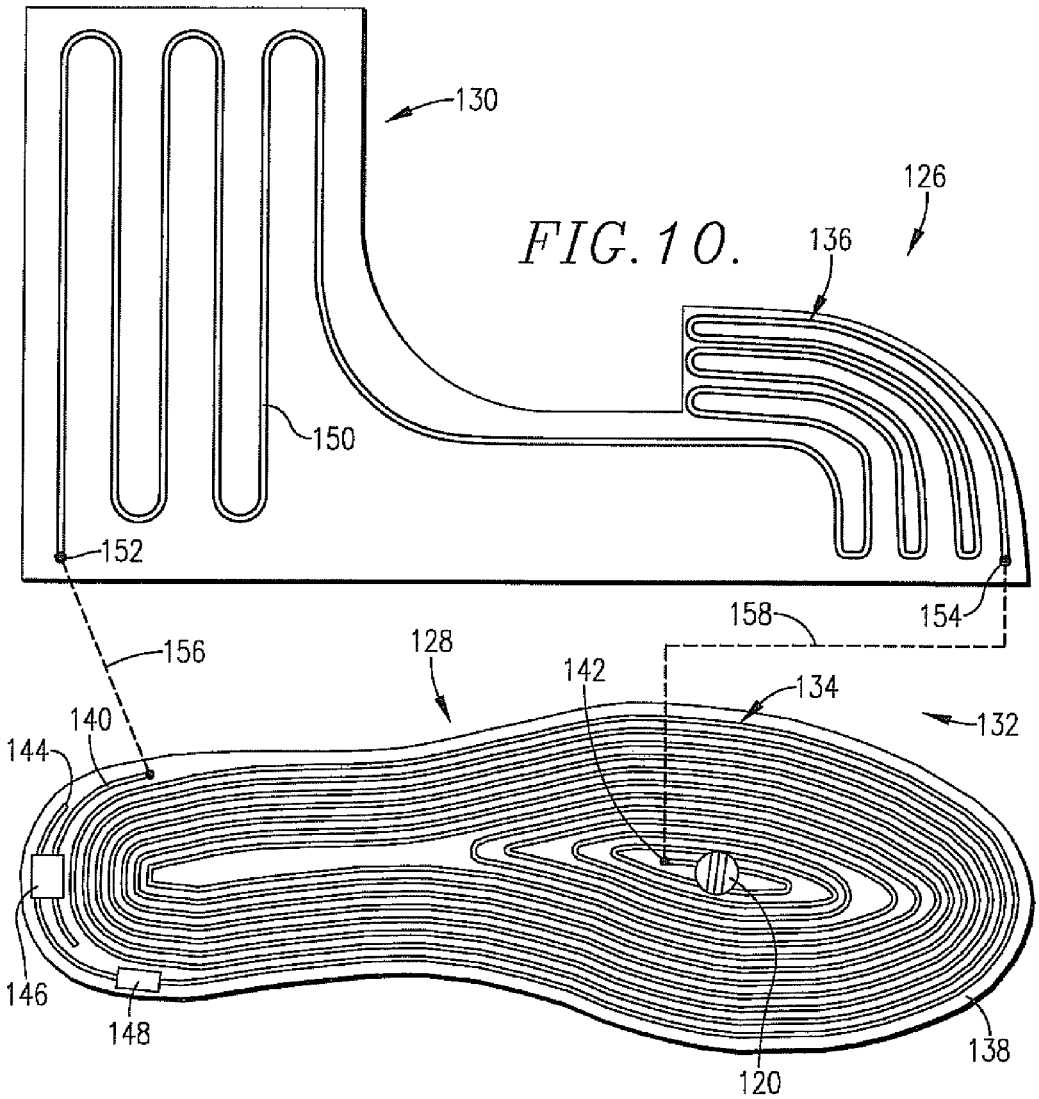
FIG. 10 is a schematic, partially exploded view of a heatable shoe insert in accordance with the invention, wherein the shoe insert includes a susceptor coil extending through the sole and upper sections of the insert.

FIG. 10 illustrates a shoe insert 126 having a bottom sole section 128 and an interconnected upper section 130. The insert 126 is a molded synthetic resin object and has a susceptor coil 132 having a sole portion 134 and an upper portion 136. The sole portion 134 includes a primary metallic tracing 138 and a secondary tracing 140. The primary tracing 138 has an inner end 142 and an outer end 144. A tuning capacitor 146 is operably connected between the end 144 and secondary tracing 140, and a temperature switch 148 is provided in the sole portion 134. The upper portion 136 includes a tracing 150 presenting convolutions through the length and width of upper section 130, including the ankle and toe regions thereof, as well as terminals 152, 154. In order to complete the susceptor coil circuit, connectors 156, 158 are connected between secondary tracing 140 and terminal 152, and between terminal 154 and inner tracing end 142. The sole portion 134 of insert 126 is also provided with a microwire sensor 120 identical to that described as referenced to FIG. 11. It should be noted that the microwire sensor 120 can lay directly atop the tracings 138 so as to maintain thermal contact with them while still being able to be detected by the microwire detector of heater 26. This ability to lay directly upon the tracings while being reliably readable is an advantage of the microwire sensor over the RFID tag/sensor design, where the RFID tag and RFID reader communications are adversely affected by the presence of conducting material either directly between the tag and reader antenna or directly behind the REID tag as viewed from the reader antenna. The advantage of microwire temperature sensors in this invention arises from the fact that more surface area of the sole section 128 of the shoe insert 126 can be inductively heated because the sole portion 134 of the susceptor coil 132 can extend into the region where the sensor 120 is positioned.

Figure 8:
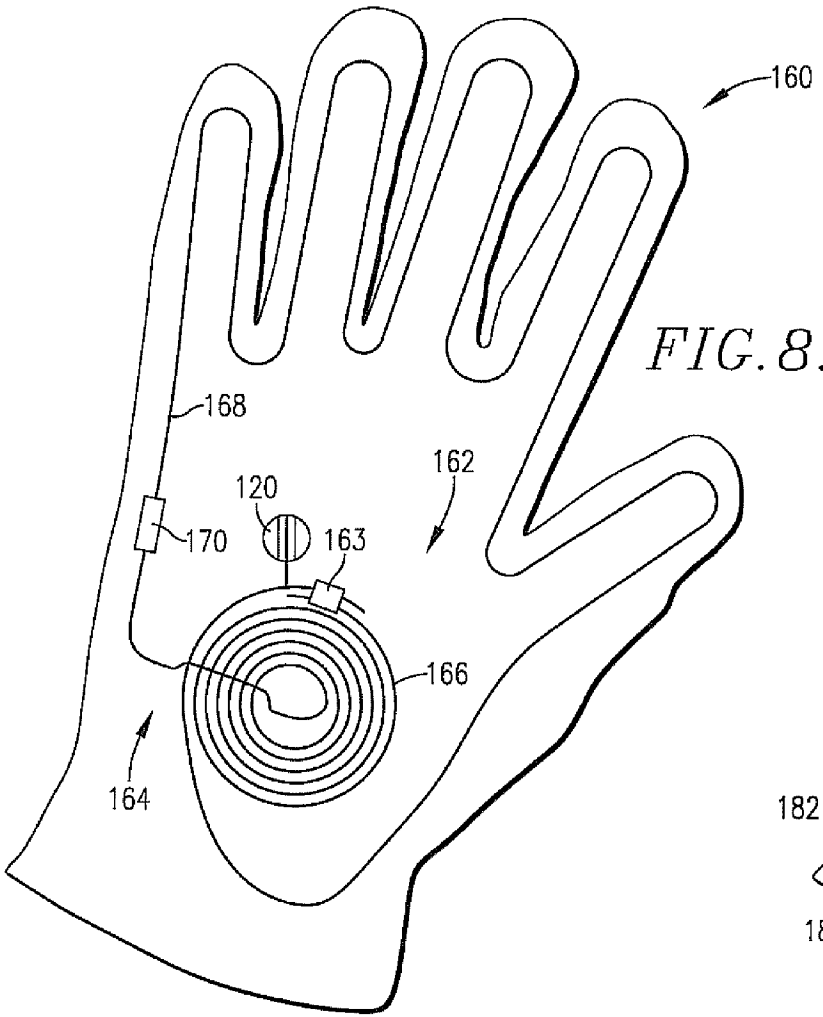
FIG. 8 is a schematic view of a heatable glove in accordance with the invention and including a susceptor coil heating assembly.

The invention has been described above in connection with induction heating of footwear. However, the invention is not limited to footwear, but is applicable to virtually any type of clothing item. Thus, FIG. 8 illustrates a glove 160 designed for induction heating. The glove 160 is typically of multiple-ply design and has induction heating apparatus located between inner and outer plys. As depicted in FIG. 8, a heating assembly 162 is provided including a susceptor coil 164 including a centrally located, circular primary section 166 and a secondary section 168 extending through the finger and thumb regions of the glove 160. The sections 166 and 168 are interconnected so as to define a complete coil circuit. A temperature switch 170 is interposed in the coil circuit as shown. A microwire temperature sensor 120 is located adjacent the primary coil section 166 and provides temperature information as described above. The sensor 120 may lie directly over a portion of the complete coil circuit to maintain thermal contact with it or may lie within other portions of the glove whose temperature is to be detected and regulated. If desired, the primary coil section 166 and sensor 120 may be mounted on a thin, flexible, temperature resistant, synthetic resin support sheet (not shown), or these components can simply be located by stitching or other means within glove 160. Furthermore, it is preferable to include heat retentive phase change material blended into, woven into, or otherwise contained within the plys of the glove so that thermal energy may be stored therein by the energy inductively transferred from the induction heater to the susceptor coil 164.

In order to heat glove 160, the glove is located adjacent a magnetic induction heater with the work coil thereof proximal to the primary coil section 166. When the heater is actuated, the alternating magnetic field will induce a heating current in the susceptor coil 164. Again, this current will flow completely through the coil 164, including the primary section 166 and secondary section 168, with consequent joule heating of the entire glove 160. Preferably, the glove 160 has heat retentive phase change material therein so that thermal energy is released over time to warm the hand of the wearer.

Figure 9:
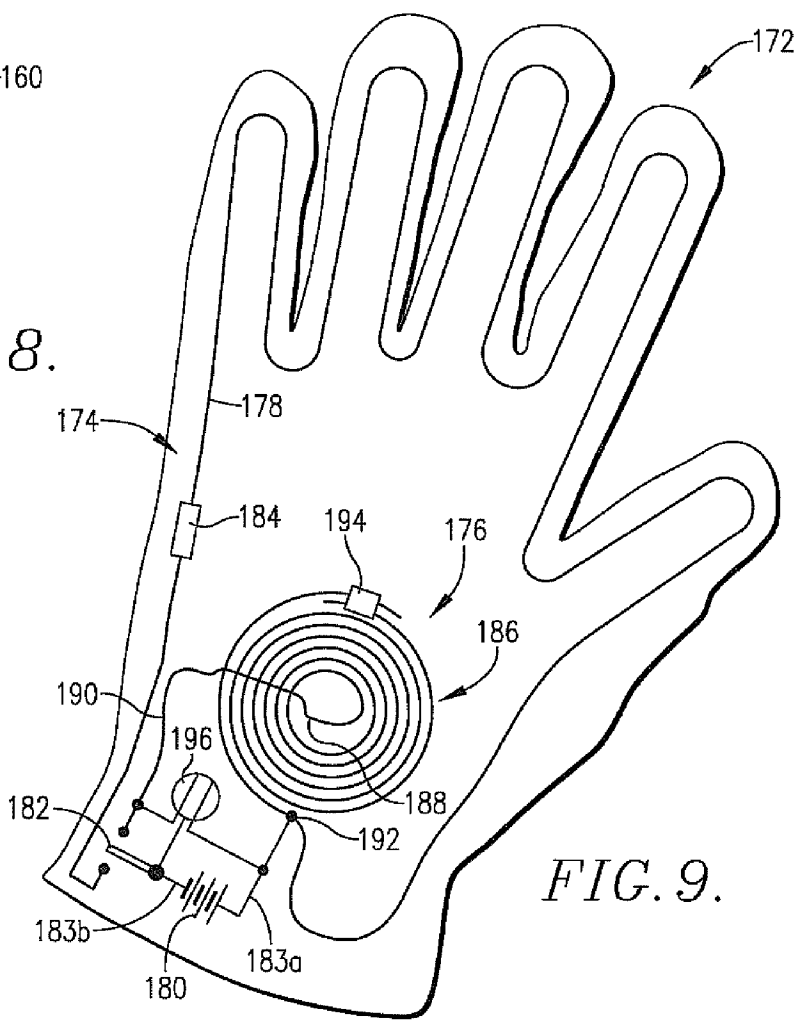
FIG. 9 is a schematic view of a heatable glove in accordance with the invention and including a battery-powered resistance heating assembly and an inductive battery charging assembly.

FIG. 9 illustrates a clothing item, here a glove 172, which is provided with a conventional battery-powered resistance heating assembly 174 and an induction battery charging assembly 176. The resistance heating assembly 174 includes a resistance wire 178 extending throughout the glove 172 along the finger, thumb, and wrist portions thereof, as well as a rechargeable battery 180 and switch 182. A pair of battery leads 183*a* and 183*b* extend from resistance wire 178 and switch 182 to the opposite poles of battery 180. A thermal switch 184 is located within resistance wire 178 as shown. In order to heat glove 172, switch 182 is moved so as to complete the circuit between battery 180 and resistance wire 178. When the heating cycle is complete, the switch 182 is moved to the open position depicted in FIG. 9.

The battery charging assembly 176 includes a circular susceptor coil 186 having an inner end 188 coupled to switch 182 via lead 190, and an outer end 192 coupled to battery lead 183*a*. The coil 186 has a tuning capacitor 194 as shown. A wireless battery charge status sensor 196 (e.g., an RFID tag or microwire sensor) is operably connected to leads 183*a* and 190, and to switch 182.

When the battery 180 needs recharging as indicated by sensor 196, the glove 172 is placed adjacent an appropriately configured induction heating device, and switch 182 is moved to the charging position, either manually or automatically, creating a complete circuit through coil 186, lead 183*a*, battery 180, lead 183*b*, switch 182, and lead 190. Upon activation of the heating device, operating data is retrieved from the sensor 196, such as type of object, maximum recharge time, optimum operating voltage, and maximum power transfer. The heating device, which in this instance serves as a recharging device, will then use such retrieved parameters to control the field strength of the alternating magnetic field to create an appropriate recharge condition for the battery 180. This is achieved by periodically monitoring the sensor 196 to determine the charge state of the battery 180. Battery charging occurs owing to the flow of current generated in coil 186 and flowing through battery 180. Normally, the battery 180 or the sensor 196 would include circuitry for active termination of charging when the recharge cycle is complete. The induction heater would then detect a drop in the output energy so as to wirelessly detect the completion of the charge cycle, and at this point the work coil of the heater would be de-energized.

Like glove 160, glove 172 also preferably includes heat retentive phase change material in the body of the glove, which is heated during charging of battery 180. Thus, the glove 172 provides sustained warming as it is worn. Additionally, the inclusion of a manual switch 182 allows for on-demand warming.

We claim:

1. A clothing item adapted to be worn and comprising:

a clothing body;

an induction heatable element operably associated with said body, said element operable to be heated when subjected to an alternating magnetic field so as to provide warmth to a wearer of the clothing item; and a device operably coupled with said element in order to limit the temperature thereof upon said heating of the element.

2. The clothing item of claim 1, said device comprising a temperature sensor associated with said element.

3. The clothing item of claim 1, said element comprising a susceptor coil.

4. The clothing item of claim 3, said susceptor coil embedded within said clothing body.

5. The clothing item of claim 1, said element comprising a matrix of magnetic susceptible material.

6. The clothing item of claim 5, said material comprising graphite.

7. The clothing item of claim 1, said device including an RFID tag and a temperature sensor operably coupled with the RFID tag.

8. The clothing item of claim 7, said temperature sensor being mounted on said RFID tag.

9. The clothing item of claim 7, said temperature sensor being spaced from said RFID tag, there being an electrical connection between the temperature sensor and RFID tag.

10. The clothing item of claim 1, said element comprising a susceptor coil, said device comprising a thermal switch operably coupled with said susceptor coil and operable to open the circuit of the susceptor coil when the coil is heated to a predetermined maximum temperature.

11. The clothing item of claim 1, said clothing item selected from the group consisting of footwear, stockings, gloves, hats, trousers, shirts, jackets, and coats.

12. A clothing assembly comprising:

a clothing item including a clothing body;

an induction heatable element operably associated with said body, said element operable to be heated when subjected to an alternating magnetic field so as to provide warmth to a wearer of the clothing item;

an induction heater configured for placement in proximity to said element and operable to generate an alternating magnetic field in order to heat said element; and a device operably coupled with said element in order to limit the temperature thereof upon said heating of the element.

13. The clothing assembly of claim 12, said device comprising a temperature sensor.

14. The clothing assembly of claim 12, said element comprising a susceptor coil.

15. The clothing assembly of claim 14, said susceptor coil embedded within said clothing body.

16. The clothing assembly of claim 12, said element comprising a matrix of magnetic susceptible material.

17. The clothing assembly of claim 16, said material comprising graphite.

18. The clothing assembly of claim 12, said device including an RFID tag and a temperature sensor operably coupled with the RFID tag.

19. The clothing assembly of claim 18, said temperature sensor being mounted on said RFID tag.

20. The clothing assembly of claim 18, said temperature sensor being spaced from said RFID tag, there being an electrical connection between the temperature sensor and RFID tag.

21. The clothing assembly of claim 12, said device operable to control the temperature of said element during the course of heating thereof.

22. The clothing assembly of claim 21, said device comprising a temperature sensor operably coupled with said element, and apparatus for wirelessly transmitting temperature information derived from said sensor to said induction heater.

23. The clothing assembly of claim 22, said apparatus comprising an RFID tag operably coupled with said sensor, said induction heater including an antenna operable to interrogate said RFID tag and to receive said temperature information from the RFID tag.

24. The clothing assembly of claim 23, said induction heater also including a controller coupled with said antenna and operable to control the output of said induction heater at least partially in response to said temperature information.

25. The clothing assembly of claim 12, said device comprising a microwire temperature sensor, said induction heater having a microwire temperature sensor reader.

26. The clothing assembly of claim 22, said apparatus comprising an impedance detection feedback control system.

27. The clothing assembly of claim 12, said clothing item selected from the group consisting of footwear, stockings, gloves, hats, trousers, shirts, jackets, and coats.

28. The clothing assembly of claim 12, said element comprising a susceptor coil, said device comprising a thermal switch operably coupled with said susceptor coil and operable to open the circuit of the susceptor coil when the coil is heated to a predetermined maximum temperature.

29. A clothing assembly comprising:

a clothing item including a clothing body;

an induction heatable element operably associated with said body, said element operable to be heated when subjected to an alternating magnetic field so as to provide warmth to a wearer of the clothing item;

an induction heater configured for placement in proximity to said element and operable to generate an alternating magnetic field in order to heat said element; and a device operably coupled with said element in order to limit the temperature thereof during the course of heating of the element, said device comprising a microwire temperature sensor operably coupled with said element and operable to sense temperature information about said element and to wirelessly transmit said information in response to an interrogating magnetic field.

30. A clothing assembly comprising:

a clothing item including a clothing body;

an induction heatable element operably associated with said body, said element operable to be heated when subjected to an alternating magnetic field so as to provide warmth to a wearer of the clothing item;

an induction heater configured for placement in proximity to said element and operable to generate an alternating magnetic field in order to heat said element; and a device operably coupled with said element in order to limit the temperature thereof upon heating of the element, said device operable to control the temperature of said element during the course of heating thereof, said device comprising a temperature sensor operably coupled with said element, and apparatus for wirelessly transmitting temperature information derived from said sensor to said induction heater, said device further comprising an impedance detection feedback control system.

* * * * *